United States Patent [19]

Ni

[11] Patent Number: 5,070,707

[45] Date of Patent: Dec. 10, 1991

[54] SHOCKLESS SYSTEM AND HOT GAS VALVE FOR REFRIGERATION AND AIR CONDITIONING

[75] Inventor: Shimao Ni, Elmhurst, Ill.

[73] Assignee: H. A. Phillips & Co., St. Charles, Ill.

[21] Appl. No.: 487,683

[22] Filed: Mar. 2, 1990

Related U.S. Application Data

[63] Continuation-in-part of Ser. No. 417,927, Oct. 6, 1989, abandoned.

[51] Int. Cl.[5] ..... F25D 21/06

[52] U.S. Cl. ..... 62/234; 62/196.4; 62/278; 137/629

[58] Field of Search ..... 62/158, 278, 196.4, 62/234, 157, 158, 223, 225; 251/30.01, 31, 36, 47, 48, 117, 210; 137/624.18, 624.19, 625.28, 625.29, 625.3, 629

[56] References Cited

U.S. PATENT DOCUMENTS

| | | | |
|---|---|---|---|
| 534,360 | 2/1895 | Collins et al. | 251/47 X |
| 1,190,681 | 7/1916 | Spitzer | 137/629 X |
| 4,615,354 | 10/1986 | Bianchi | 137/629 X |
| 4,651,535 | 3/1987 | Alsenz | 62/223 |

*Primary Examiner*—Harry B. Tanner

*Attorney, Agent, or Firm*—Willian Brinks Olds Hofer Gilson and Lione

[57] ABSTRACT

A refrigeration system utilizing hot gas for defrost and a hot gas defrost valve with specific opening characteristics for rapidly reducing the pressure gradient across the valve without producing hydraulic shock. When defrost is called for by the system, the hot gas defrost valve is opened in a manner which prevents a liquid or liquid-gas slug from impacting on cold system components and producing liquid hammer effect damage.

7 Claims, 5 Drawing Sheets

SHOCKLESS SYSTEM AND HOT GAS VALVE FOR REFRIGERATION AND AIR CONDITIONING

STATEMENT OF RELATED APPLICATIONS

This application is a continuation-in part of a commonly-assigned co-pending U.S. patent application also entitled "IMPROVED SHOCKLESS SYSTEM AND HOT GAS VALVE FOR REFRIGERATION AND AIR CONDITIONING", having Ser. No. 07/417,927, abandoned and filed Oct. 6, 1989. The entire disclosure of the above application is incorporated herein by reference.

This application is also related to a commonly-assigned U.S. patent application filed concurrently herewith, having Ser. No. 487,683, and relating to a "SLUG SURGE SUPPRESSOR FOR REFRIGERATION AND AIR CONDITIONING SYSTEMS". The entire disclosure of the above application is also incorporated herein by reference.

FIELD OF THE INVENTION

This invention relates generally to the field of refrigeration and air conditioning. More particularly, it relates to a system for industrial and commercial refrigeration, air conditioning and system defrosting.

BACKGROUND OF THE INVENTION

A conventional system for industrial and commercial refrigeration or air conditioning might employ ammonia, for example, as a refrigerant. The ammonia, in gaseous form, is compressed in a compressor, from which it is discharged at a higher temperature and pressure. The compressed refrigerant gas travels to a condenser where it is liquified at a lower temperature. Cooled liquid refrigerant then travels through evaporator coils where it performs its cooling or refrigeration function by removing heat from the surrounding environment through the coils.

The evaporator coils normally accumulate moisture and, accordingly, frost during operation. Periodically these evaporator coils have to be defrosted in order to maintain the efficiency of the system. There are four widely used methods of defrosting evaporator coils. These might be characterized as the air method, the water method, the electric method and the hot gas method.

The hot gas defrost method is the most popular of the four. In the hot gas defrost method the supply of liquid refrigerant to the evaporator coil is interrupted and high pressure refrigerant vapor is delivered to the evaporator. While the high pressure refrigerant vapor is being delivered to the evaporator coil, the outlet of the coil is restricted so that a pressure is maintained in the coil. This provides a saturation temperature high enough to transfer heat to the frost or ice on the evaporator coils. As a result of this manipulation, the evaporator coil temporarily becomes a condenser coil. The latent heat given off into the frost during the condensation process is the major energy source for defrost.

To begin the defrost cycle, a first solenoid valve downstream of the condenser is closed and a second solenoid valve in a bypass line which leads directly from upstream of the condenser to upstream of the evaporator is opened. These solenoid valves normally open and close rapidly. When the bypass line has some liquid in it in addition to the hot gas from the compressor (as is frequently the case) a "slug" of liquid or a liquid-gas mixture rapidly passes through the second solenoid valve and strikes downstream system components, including the evaporator. What is known as "hydraulic shock" occurs and, particularly where the system is operating at low temperatures, severe damage to the system can result.

SUMMARY OF THE INVENTION

A primary object of the present invention is to provide an improved shockless, hot gas defrost refrigeration system for industrial and commercial refrigeration and air conditioning and the like.

It is another object to provide an improved refrigeration system wherein hydraulic shock damage to system components due to rapid opening or closing of control valves is prevented.

Yet another object is to provide a refrigeration system wherein slug flow in the pipe line is prevented from rapidly moving downstream or being rapidly stopped so as to cause hydraulic shock, a result potentially damaging to system components.

Still another object is to provide an improved shockless valve.

The foregoing and other objects are realized in accordance with the present invention by providing an improved refrigeration system utilizing hot gas for defrost and controlling the use of that hot gas in a manner which optimizes the efficiency of system operation while effectively preventing shock damage to system components during defrost. A hot gas defrost valve with specific opening and closing characteristics rapidly reduces the pressure gradient across the defrost valve without producing shock upstream or downstream of the valve.

In one aspect of the invention, a shockless defrost valve operated by solenoids is automatically self-controlled by the downstream pressure of the valve. When valve opening is called for, a pilot solenoid valve opens a regulatory passage. The resistance of the regulatory passage to the hot gas flow reduces the pressure gradient of the flow and thus eliminates the possibility of a shock wave being propagated. By raising the gas pressure downstream, the flow through the regulatory passage further reduces the pressure differential across the valve. When the downstream pressure due to the outlet pressure control of the evaporator increases to a preset value, a diaphragm driven by the control pressure from downstream moves and opens a passage for the gas from upstream of the valve to drive a power piston downward. The power piston in turn moves a valve plug which opens the main passage. Since the pressure differential across the valve is reduced, hydraulic shock is prevented. When the hot gas defrost process finishes, the solenoid is de-energized. The regulatory passage closes and hence the gas supply driving the power piston is cut off. The power piston is pushed up by a spring thereby pulling up the valve plug and closing the main passage.

In another aspect of the invention, a shockless defrost valve operated by solenoids is controlled with an electronic timer. When valve opening is called for, a pilot solenoid valve opens a regulatory passage and, at the same time, an electronic timer is actuated. The resistance of the regulatory passage to the hot gas flow reduces the pressure gradient of the flow and thus eliminates the possibility of a shock wave being propagated. The flow through the regulatory passage raises the gas pressure downstream and hence reduces the pressure differential across the valve. After a minimum time duration necessary for the pressure differential across the valve to become sufficiently low, the timer actuates the main solenoid valve and opens the valve to full flow. When the valve starts closing, the valve operates in a reverse order compared to that during opening. The main passage closes first. The smaller passage remains open until the electronic timer deenergizes the pilot solenoid valve. Since the flow speed is restricted by the smaller passage, hydraulic shock is prevented.

In yet another aspect of the invention, a mechanical control system is used for the valve. A solenoid is energized to remove an auxiliary valve, such as a needle valve or the like, to open a pilot passage. Upstream pressure pushes a power piston downwardly. A main plug opens and hot gas flows downstream. The power piston drives a counter piston downwardly, and downward movement of the counter piston is resisted by gas sealed in a damping cylinder, as well as the mechanical effects of a closing spring. The moving speed of the power piston and the counter piston is controlled by the piston area, the dimensions of the pilot passage plug and capillary passage, the friction force between the pistons and cylinder wall and the strength of the closing spring. When the valve starts closing, the solenoid is deenergized. Small bleed passages in the valve permit the pistons to slowly return the main plug to its closing position. The gentle opening and closing of the valve prevents hydraulic shock.

BRIEF DESCRIPTION OF THE DRAWINGS

The invention, including its construction and method of operation, together with additional objects and advantages thereof, is illustrated more or less diagrammatically in the drawings, in which.

DESCRIPTION OF THE PREFERRED EMBODIMENTS

Figure 1:
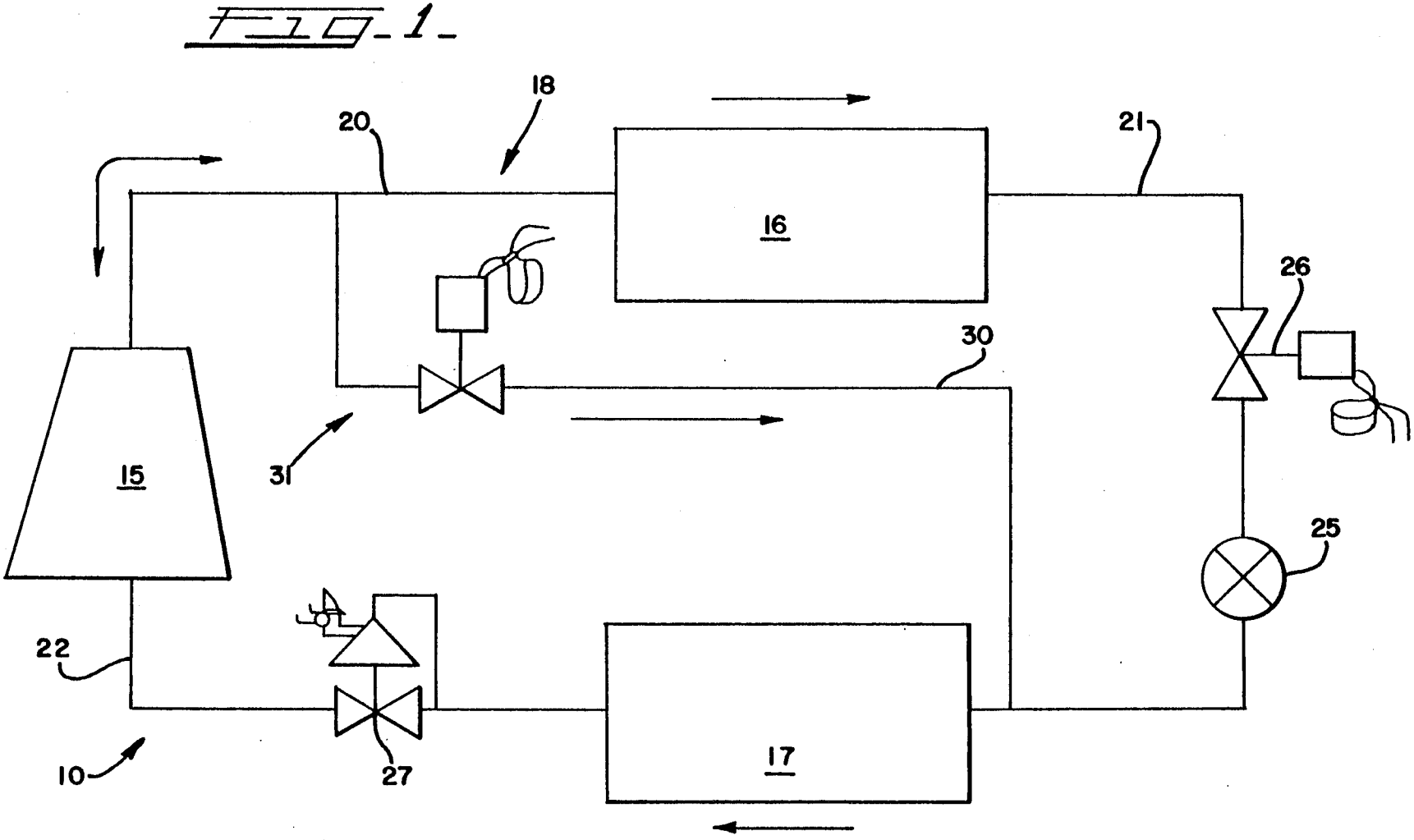
FIG. 1 is a block diagram of a system embodying features of the present invention.

Referring now to the drawings, and particularly to FIG. 1, a system embodying features of the present invention is illustrated in block diagram at 10. The system 10 is illustrated in the context of a commercial refrigeration system and includes a refrigerant compressor 15 in closed circuit with a condenser 16 and an evaporator 17, all connected by a pipe assembly 18. The compressor 15 and the condenser 16 are connected by a pipe segment 20, the condenser and evaporator by a pipe segment 21, and the evaporator and compressor by a pipe segment 22. These components are of known construction and arrangement and are commercially available.

The pipe segment 21 includes an expansion valve 25. Upstream, next to the expansion valve 25, a solenoid operated control valve 26 is mounted in the pipe segment 21. The control valve 26 is designed to selectively close communication between the condenser 16 and the evaporator 17 through the pipe segment 21 during hot gas defrost, and is preferably constructed according to the invention in a manner hereinafter described.

The pipe segment 22 includes a pressure regulator valve 27. The pressure regulator valve 27, downstream of the evaporator 17 and upstream of the compressor 15, regulates the flow of gaseous refrigerant to the compressor from the evaporator.

The system 10 also includes a hot gas defrost pipe segment 30. The pipe segment 30 is connected to the pipe segment 20 upstream of the condenser 16, and to the pipe segment 21 downstream of the expansion valve 25 and upstream of the evaporator 17. A hot gas defrost valve 31 embodying features of the present invention is disposed in the hot gas defrost pipe segment 30.

In normal operation of the system 10 as a refrigeration system, the compressor 15 receives refrigerant gas from the evaporator 17 through the pressure regulator valve 27. The evaporator 17, in performing its refrigeration function in a commercial refrigeration system, for example, has converted the refrigerant from a liquid to a gas. This gas is compressed by the compressor 15, after which it passes downstream through the pipe 20 into the condenser 16.

The condenser 16 liquifies the pressurized gas by removing heat from the gas, and the liquified refrigerant leaves the condenser 16 through the pipe segment 21 for the expansion valve 25. In the expansion valve 25 a reduction in pressure of the liquified refrigerant takes place. The liquified refrigerant, at a reduced pressure, passes downstream into the evaporator 17 where it evaporates, absorbing heat from its surroundings.

During a refrigeration operation of the aforedescribed nature, it is not unusual for the evaporator coils to accumulate frost as the system operates. This frost builds up especially rapidly where a system is operating in a high humidity environment. As the frost builds up, the refrigeration effect of the evaporator coils is reduced.

Normally the hot gas defrost pipe segment 30 is closed by the hot gas defrost valve 31 while the pipe segment 21 remains open through valve 26. When a defrost cycle is called for the valve 26 is closed and the hot gas defrost valve 31 is opened. The pressure regulator valve 27 is held wide open during normal refrigeration operation, but is de-energized during defrost and becomes a regulator of pressure upstream of the evaporator 17.

With the valve 26 closing off the pipe segment 21, and the hot gas defrost valve 31 opening the pipe segment 30, high pressure refrigerant gas is delivered to the evaporator 17. While this high-pressure gas is being supplied to the evaporator 17, the outlet from the coil of the evaporator 17 is restricted by the pressure regulator valve 27 so that sufficient pressure is maintained in the evaporator coil to provide a saturation temperature high enough to melt the frost. During defrost the evaporator coil functions as a condenser.

The valve 31 construction and operation has been found to be an important factor in optimizing system efficiency while providing shockless hot gas defrost. According to the present invention the valve 31 is constructed and arranged so that it opens the pipe segment 30 to maximum hot gas flow as soon as possible, while preventing the rapid passage of a liquid "slug" which might cause shock damage downstream. As a result, defrost is effected quickly, with minimum refrigeration interruption, while costly repair work caused by shock damage is avoided.

Figure 2A:
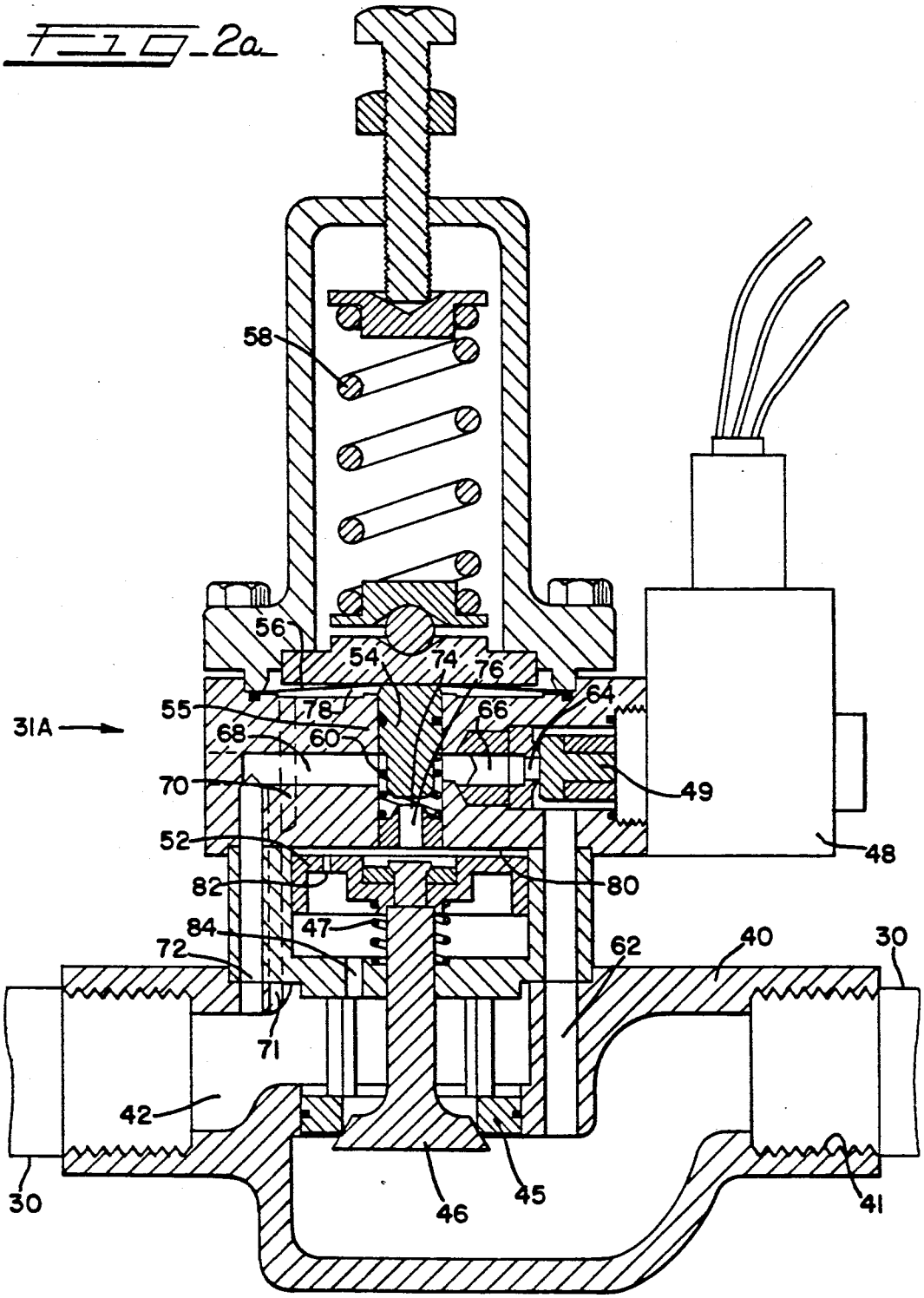
FIG. 2*a* is a partial sectional view through a first embodiment of shockless valve for the system illustrated in FIG. 1.

Referring now to FIG. 2*a*, a first embodiment of the hot gas defrost valve is illustrated in detail at 31A. The valve 31A includes a valve body 40 having an inlet port 41 and an outlet port 42. The inlet port 41 is connected to the pipe segment 30 upstream of the valve body 40 while the outlet port 42 is normally connected to the pipe segment 30 downstream of the valve body.

Within the valve body 40, between the inlet port 41 and the outlet port 42, is a relatively large diameter valve seat 45. A vertically moveable valve plug 46 is normally seated on the valve seat 45 to close communication between the inlet port 41 and the outlet port 42. The valve plug 46 is attached at one end to a power piston 52 which is biased upwardly by a coil spring 47 thus maintaining the valve plug 46 in its seated position.

The valve plug 46 may be moved downwardly from its seated-closed position to its unseated-open position, by movement of the power piston 52 downwardly against the bias of the coil spring 47. Movement of the power piston 52 downward is selectively effected by the presence of gas under pressure in a chamber 80 via consecutive passages 62, 64, 66, 74 and 76. Passage 74 is opened by movement of another piston 54 against the bias of a diaphragm 56 which itself moves against the bias of a coil spring 58. Movement of the diaphragm 56 is selectively effected by the presence of gas under pressure in a chamber 78 via outlet port 42 and passages 70 and 71.

Figure 2B:
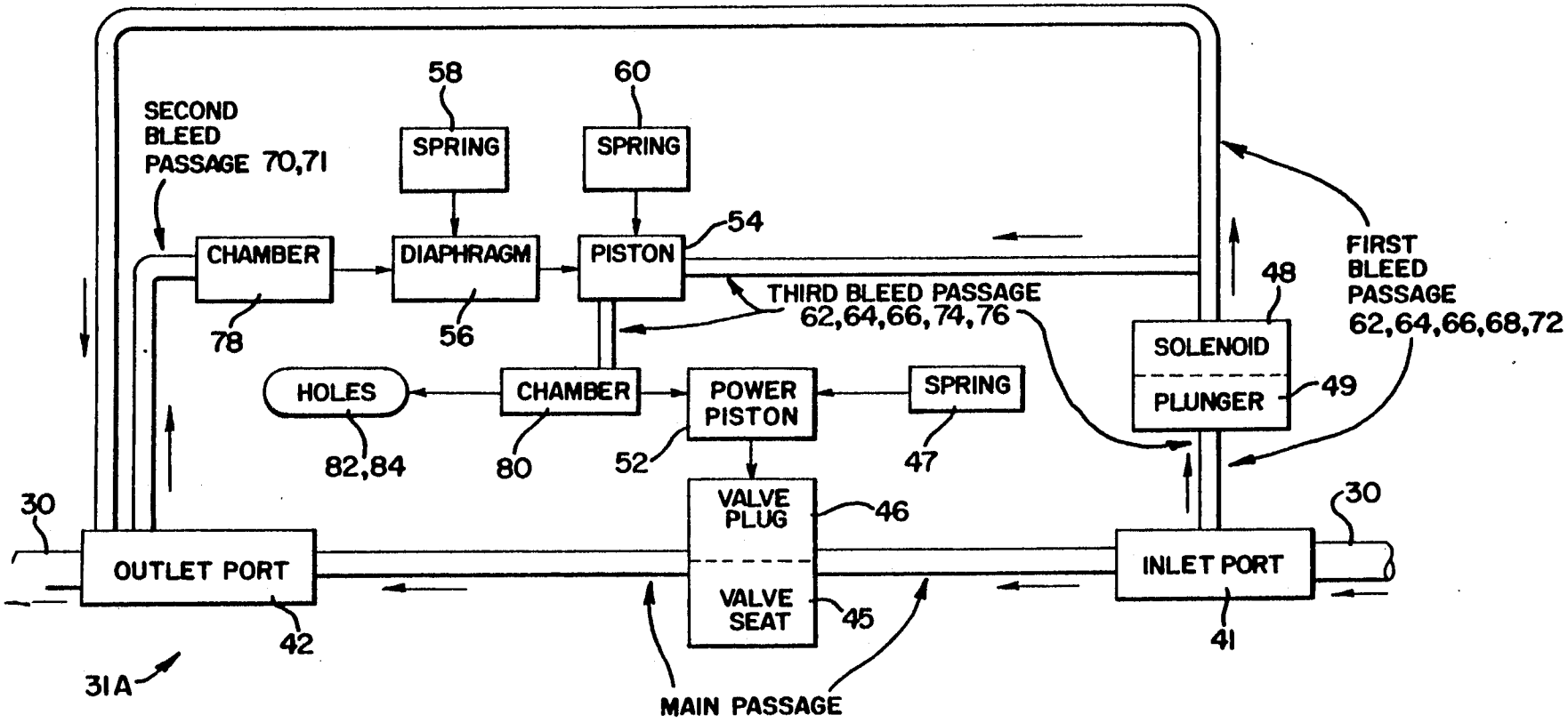
FIG. 2*b* is a block diagram illustrating the flowpath of the shockless valve illustrated in FIG. 2*a;*

Referring now to FIG. 2*a* and the block diagram illustrated in FIG. 2*b*, the flowpath of hot gas through the valve 31A will be described. During normal operation of the system 10, the valve plug 46 sits on the valve seat 45 thus closing off the main passage from the inlet port 41 through the valve seat 45 to the outlet port 42. When defrost is called for by an operator or other control mechanism, a solenoid 48 is energized and a plunger 49 is pulled to open passage 64. Hot gas enters the inlet port 41 and flows through a first bleed passage comprising regulatory passages 62, 64, 66, 68 and 72 and outlet port 42. The various regulatory passages must be of sufficiently small size to give resistance to the refrigerant flow, and thus reduce the pressure gradient of the gas flow and eliminate hydraulic shock. On the other hand, the regulatory passages must be of sufficiently large size to increase pressure downstream of the outlet port 42 as quickly as possible. An internal diameter (ID) of ¼ inch for the regulatory passages is suitable.

A second bleed passage formed by passages 71 and 70, connects the outlet port 42 with a pressure chamber 78 wherein the moveable diaphragm 56 forms one wall of the chamber 78. When the pressure at the outlet port 42 and hence the pressure in the pressure chamber 78 reaches a preset value, the diaphragm 56 is pushed up against the downward bias of the spring 58. The strength of the spring 58 determines the pressure threshold needed to move the diaphragm 56 and thus determines the preset value. As the diaphragm 56 moves up, the piston 54 is now given room to move and is pushed up by another spring 60. For a given application of the present invention, the strength of spring 60 will depend primarily on the size of the piston 54, the strength of spring 56 and the friction between the piston 54 and a cylinder 55 which houses the piston 54. For the present embodiment, a preload of 5 lbs. was chosen. The piston 54 opens passage 74 as it moves up. Upstream gas enters a chamber 80 through a third bleed passage now formed by passages 62, 64, 66, 74 and 76 and then pushes the power piston 52 downward. The power piston 52 in turn moves the valve plug 46 downward and opens the main passage of the valve 31A through valve seat 45.

When hot gas defrost ends, the solenoid 48 is de-energized and the plunger 49 closes passage 64. As gas flow diminishes, the residue gas in the chamber 80 vents through holes 82 and 84, and the gas pressure in the chamber 80 becomes equal to that at the outlet port 42. The coil spring 47 returns the power piston 52 and hence the valve plug 46 upward into the valve seat 45 to seal off the main passage of the valve 31A.

For a preset pressure valve of 70 psig, the parameters chosen for the various springs used in this embodiment include the following:

| | Preload (lbs) | Spring Constant (lb/inch) |
|---|---|---|
| Spring 58 | adjustable | 1000 |
| Spring 60 | 5 | 15 |
| Spring 47 | 0.6 | 1 |

Figure 3:
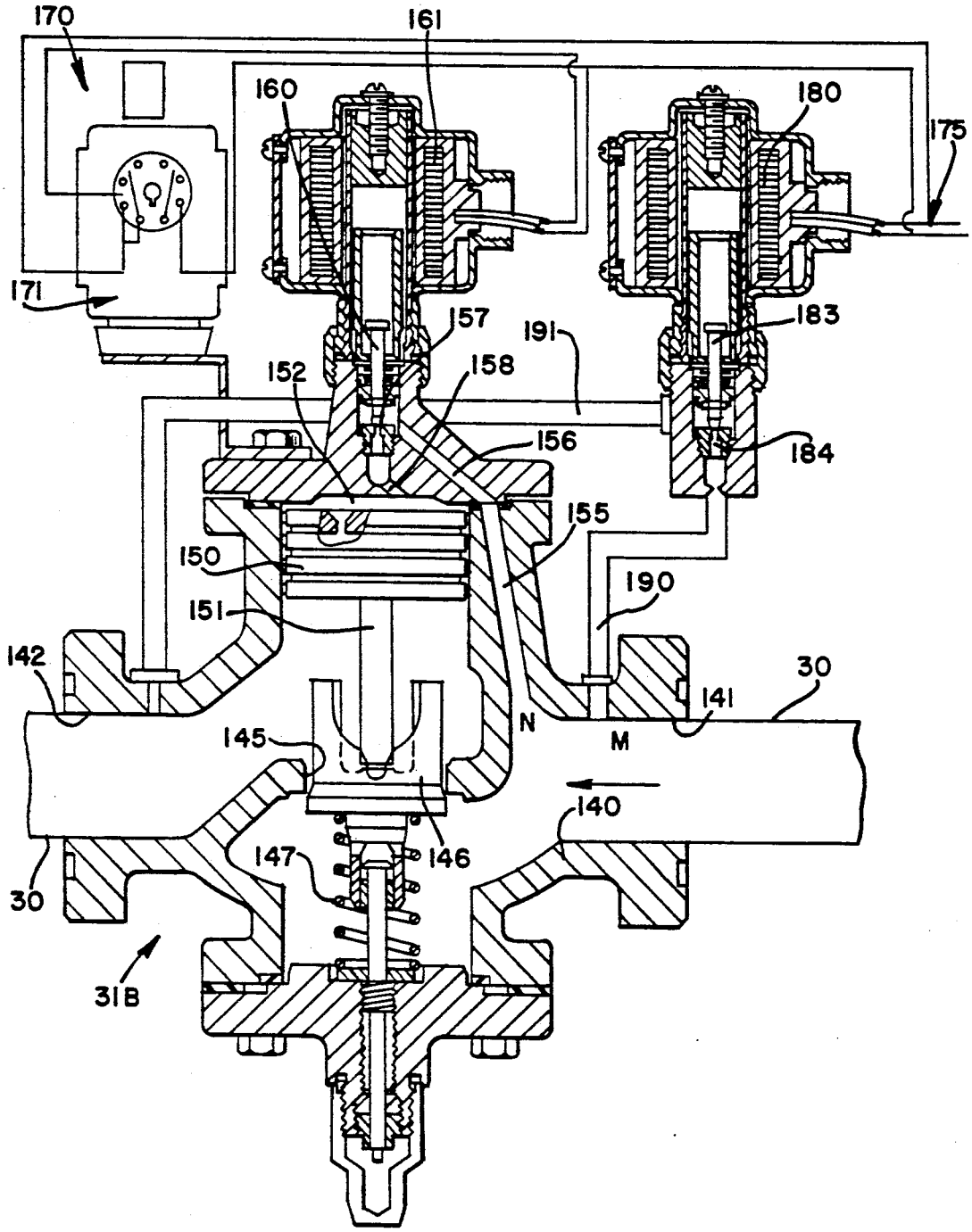
FIG. 3 is a partial sectional view through a second embodiment of a shockless valve for the system of FIG. 1.

Referring now to FIG. 3, a second embodiment of the hot gas defrost valve is illustrated in detail at 31B. The valve 31B includes a valve body 140 having an inlet port 141 and an outlet port 142. The inlet port 141 is connected to the pipe segment 30 upstream of the valve body 140 while the outlet port 142 is connected to the pipe segment 30 downstream of the valve body.

Within the valve body 140, between the inlet port 141 and the outlet port 142, is a relatively large diameter valve seat 145. A vertically moveable valve plug 146 is normally seated on the valve seat 145 to close communication between the inlet port 141 and the outlet port 142. The valve plug 146 is biased upwardly toward its seated position by a coil spring 147.

The valve plug 146 may be moved downwardly, from its seated-closed position to its unseated-open position, against the bias of the spring 147, by movement of a control piston 150 and its depending actuator pin 151. Movement of the control piston 150 downwardly, to force the valve plug 146 downwardly against the bias of the spring 147, is selectively effected by gas under pressure at the inlet port 141 escaping to the chamber 152 above the piston 150 via a first bleed passage 155, a second bleed passage 156, a needle-valve opening 157, and a third bleed passage 158.

This gas flow is controlled by a needle-valve 160 normally seated in the needle-valve opening 157, held in that position by a solenoid valve operator 161. The solenoid valve operator 161 is controlled in a conventional manner through the electrical circuit 170 by an electrical timer 171. The electrical timer 171 receives power from a suitable source through the leads 175.

The leads 175 also have a direct connection to another solenoid valve operator 180. The solenoid valve operator 180 is effective to control movement of a needle-valve 183, which opens and closes a needle-valve opening 144 in a defrost valve by-pass pipe assembly 185.

The by-pass pipe assembly 185 includes an inlet pipe segment 190 from the valve body 140 adjacent the inlet port 141 thereof, and an outlet pipe segment 191 to the valve body 140 adjacent the outlet port 142. The pipe segments 190 and 191 are of a smaller diameter, compared to the diameter of the ports 141 and 142 and the valve port seat 145 in the valve body. With the needle-valve 183 open, the pipe segment 190 and 191 produce a restricted volume flow of gas under pressure from the pipe 30 upstream of the valve body 140 to the pipe 30 downstream of the valve body.

When defrost is called for by an operator or other control mechanism the valve 26 is actuated to close the pipe segment 21. Simultaneously, or slightly sooner, the valve 31B is actuated to open the pipe segment 30 according to the present invention. In the first stage of valve 31B operation, the timer 171 is turned on and the solenoid 180 energized to withdraw the needle-valve 183 from the valve seat 184. Hot gas under pressure passes through the reduced diameter pipe segments 190 and 191 to the downstream side of the valve 31, reducing the pressure differential across the valve 31.

After this flow has been established, and a predetermined amount of time has elapsed, the timer 171 is effective to energize the solenoid 61 and open the needle-valve 160. Hot gas under pressure then passes through the bleed passages 155, 156 and 158 to the chamber 152 above the control piston 150, forcing the control piston 150 downwardly against the bias of the spring 147. This is effective to move the valve element 146 downwardly and open complete flow through the valve port 145. Hot gas flows through the pipe 30 downstream into the evaporator 17, heating its coils and causing accumulated frost to dissipate.

After defrost has been completed in a minimum time by maximum hot-gas flow, the valve 31B is closed by the timer 171 controlled solenoids 161 and 180. The solenoid 161 closes the needle valve 160, first gas pressure in the chamber 152 decreases and the spring 157 forces the plug 146 upwardly to seat in the opening 145. The solenoid 180 keeps the needle-valve 183 retracted so that fluid communication between the inlet port 141 and the outlet port 142 of the valve body 140 is maintained through the smaller pipe segments 190 and 191 for a short period of time. The solenoid 180 then closes the needle valve 183.

In the third embodiment of the invention a valve identical to valve 31B is used for the solenoid valve 26. When valve 26 closing is called for, the timer 171 is wired in such a way that it delays closing a solenoid controlled, reduced diameter by-pass passage while the main valve closes. After a short delay, the timer calls for closing of the by-pass passage and the valve 26 is completely closed. When opening the valve 26, the sequence is reversed. This sequencing also effectively avoids any shock damage at the valve 26.

Figure 4:
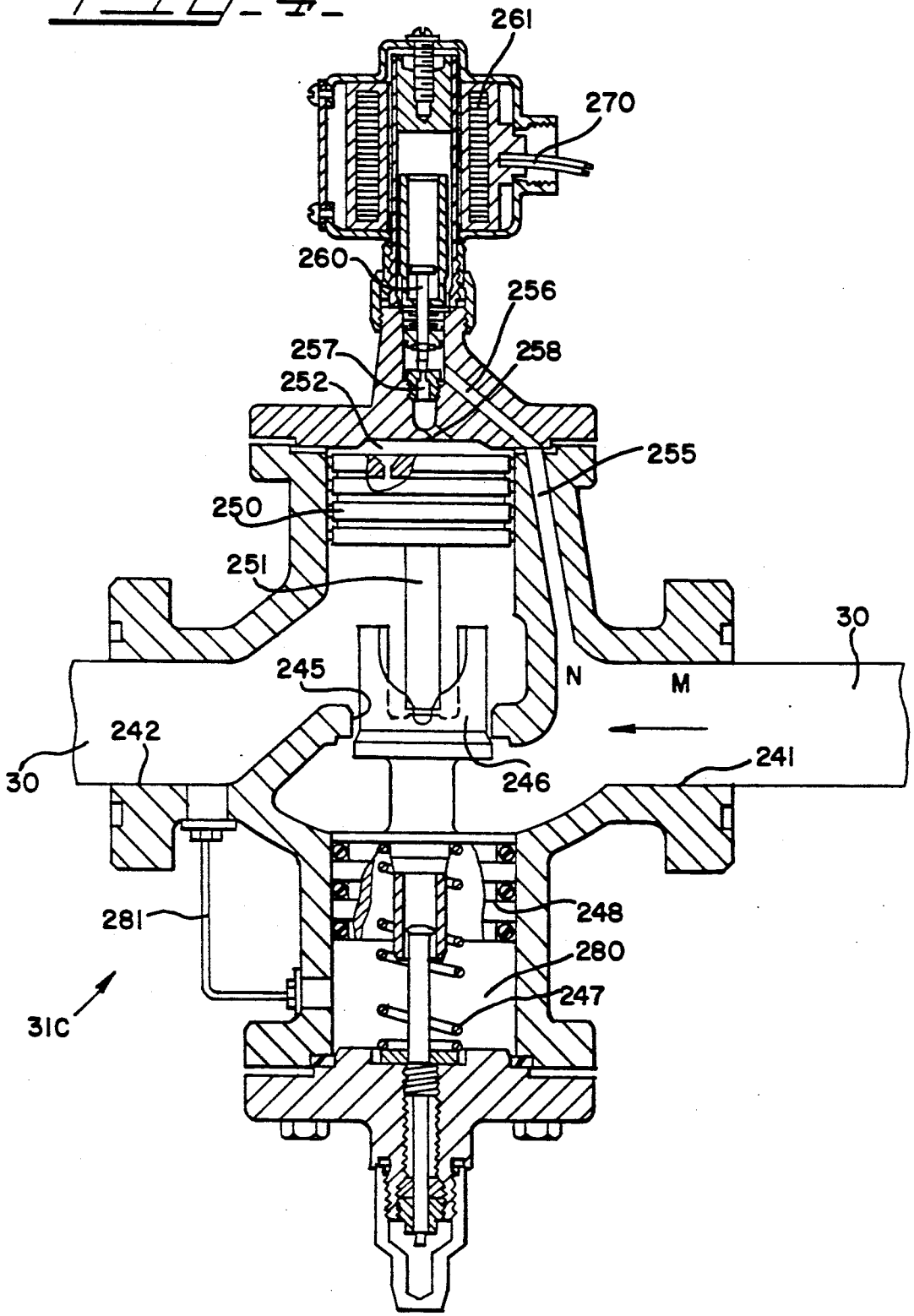
FIG. 4 is a partial sectional view through a third embodiment of a shockless vale for the system of FIG. 1.

Referring now to FIG. 4, a fourth embodiment of control valve for use in the system 10 is illustrated at 31C. The valve 31C includes a valve body 240 having an inlet port 241 and an outlet port 242. The inlet port 241 is connected to the pipe segment 30 upstream of the valve body 240 while the outlet port 242 is connected to the pipe segment 30 downstream of the valve body.

Within the valve body 240, between the inlet port 241 and the outlet port 242, is a large diameter valve seat 245. A vertically moveable valve plug 246 is normally seated on the valve seat 245 to close communication between the inlet port 241 and the outlet port 242, biased upwardly toward its seated position by a coil spring 247.

The valve plug 246 may be moved downwardly, from its seated position to its unseated position, against the bias of the spring 247 and the resistance of a counter piston 248, by movement of a power piston 250 and its depending actuator pin 251. Movement of the power piston 250 downwardly is selectively effected by gas under pressure at the inlet port 241 flowing to the chamber 252 above the piston 250 via a first bleed passage 255, a second bleed passage 256, a needle valve opening 257, and a third bleed passage 258. This gas flow is controlled by a needle-valve 260. The needle-valve 260 is normally seated in the needle-valve opening 257. A solenoid valve operator 261 is designed to remove the needle valve 260 from the opening 257 on command of a suitable actuator switch (not shown) connecting the electrical circuit leads 270 to a power source (not shown).

In operation of the valve 31C according to the present invention, when defrost is called for the solenoid 261 is actuated to lift the needle-valve 260. Hot gas under pressure then passes through the bleed passages 255, 256 and 258 to the chamber 252, urging the power piston 250 and valve plug 246 downwardly.

The counter piston 248 resists movement of the valve plug 246 downwardly because gas is trapped in the chamber 280 beneath it. However this chamber 280 is connected by a small capillary conduit 281 to the valve port 242 downstream of the valve plug 246. As a result, the plug 246 is permitted to move downwardly, albeit slowly. For given operating conditions, the moving speed of the plug 246 is controlled by the relative dimensions of the pistons 250 and 248, the relative dimensions of the bleed passages 255, 256, 258 and the capillary passage 281, the strength of the spring 247, and the upstream and downstream gas pressure.

While preferred embodiments of the invention have been described, it should be understood that the invention is not limited to them. Modifications may be made without departing from the invention. The scope of the invention is defined by the appended claim, and all devices that come within the meaning of the claims, either literally or by equivalents, are intended to be embraced therein.

I claim:

1. An improved hot gas defrost system wherein shock damage to system components is prevented, comprising:

a) a refrigerant compressor connected in closed circuit with a condenser and an evaporator by a pipe assembly;

b) said pipe assembly including a first pipe segment connecting the compressor and the condenser, a second pipe segment connecting the condenser and the evaporator, and a third pipe segment connecting the evaporator and the compressor;

c) a hot gas defrost pipe segment connected to said first pipe segment and the second pipe segment of said pipe assembly; and d) a hot gas defrost valve disposed in said hot gas defrost pipe segment;

e) said hot gas defrost valve including means for opening said hot gas defrost pipe segment to a maximum extent to permit hot gas to flow therethrough, and means for reducing the pressure differential across said valve before said valve is opened to said maximum extent;

f) said means for opening said hot gas defrost pipe segment to a maximum extent includes a valve body having an inlet port and an outlet port;

g) a valve plug located inside said valve body and further being moveably situated inside a main valve seat also located inside said valve body;

h) said valve seat being located between and in open communication with said inlet port and said outlet port;

i) said means for reducing the pressure differential across said valve includes a first bleed passage connecting said inlet port to said outlet port; and j) means for completely opening or completely closing said first bleed passage.

2. The improved system of claim 1 further characterized in that:

a) said means for reducing the pressure differential across said valve further includes a second bleed passage connecting said outlet port to a first chamber and providing an unobstructed path for fluid flow from said outlet port to said first chamber;

b) said first chamber in communication with a first moveable member biased in a first position, whereby the build up of fluid pressure at said outlet port results in a build up of fluid pressure in said first chamber to a level sufficient to counteract said bias of said first moveable member whereby the fluid pressure in said first chamber acts to move said first moveable member against said bias to a second position;

c) when in said second position said first moveable member opening a third bleed passage whereby fluid is transported from said inlet port into contact with a second moveable member whereby fluid pressure from said inlet port moves said second moveable member which moves said valve plug out of engagement with said valve seat, thereby opening said valve to said maximum extent.

3. The improved system of claim 2 further characterized in that said second moveable member includes;

a) a first piston biased downward by said first moveable member against the bias of a biasing means when said first moveable member is in said first position, and biased upward by said biasing means when said first moveable member is in said second position;

b) when biased upward, said first piston opening said third bleed passage connecting said inlet port with a second pressure chamber in communication with a second piston;

c) said second piston being biased upward whereby the build up of fluid pressure in said second chamber to a level sufficient to counteract said second piston bias acts to move said second piston downward;

d) said second piston in communication with said valve plug such that downward movement of said second piston initiates downward movement of said valve plug out of engagement with said valve seat.

4. The improved system of claim 1 further characterized by and including:

a) a solenoid actuated valve for closing communication through said second pipe segment when said hot gas defrost pipe segment is opened;

b) said solenoid actuated valve including means for increasing the fluid pressure downstream of said solenoid actuated valve and reducing the pressure differential across said hot gas defrost valve before said hot gas defrost valve is opened.

5. The improved system of claim 1 further characterized in that said means for completely opening or completely closing said first bleed passage includes a first solenoid operated needle-valve.

6. The improved system of claim 5 further characterized in that:

a) said valve plug is moveable out of engagement with said valve seat by a piston within said valve body, said piston being movable in a cylinder which contains a compression chamber opposite the piston from said plus;

b) a second bleed passage connecting said inlet port with said chamber;

c) a second solenoid operated needle-valve in said second bleed passage for opening and closing fluid flow through said second bleed passage.

7. The improved system of claim 6 further characterized by and including:

a) a timer connected to each of said solenoid valves and adapted, when hot gas defrost valve opening is called for, to initially cause opening of said first solenoid valve and then, after a predetermined delay, cause opening of said second solenoid valve.

* * * * *